US007290696B2

(12) United States Patent
McClure

(10) Patent No.: US 7,290,696 B2
(45) Date of Patent: Nov. 6, 2007

(54) CONTAINER WITH REINFORCED CORNER PANELS AND THE ASSOCIATED CONTAINER BLANK

(75) Inventor: Jack A. McClure, Omaha, NE (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 11/171,043

(22) Filed: Jun. 30, 2005

(65) Prior Publication Data

US 2007/0000984 A1 Jan. 4, 2007

(51) Int. Cl.
*B65D 5/28* (2006.01)
*B65D 5/468* (2006.01)

(52) U.S. Cl. ..... 229/143; 229/117.16; 229/153; 229/191

(58) Field of Classification Search ..... 229/117.16, 229/141, 142, 143, 152, 153, 154, 190, 191, 229/915, 918, 919
See application file for complete search history.

(56) References Cited

U.S. PATENT DOCUMENTS 2,316,261 A * 4/1943 Levkoff ..... 229/152
2,857,090 A * 10/1958 Fallert ..... 229/154
4,056,223 A * 11/1977 Williams ..... 229/191
4,319,710 A * 3/1982 Osborne ..... 229/190
4,546,913 A * 10/1985 Castillo ..... 229/191
5,000,377 A * 3/1991 McClure ..... 229/918
5,285,956 A * 2/1994 Piepho ..... 229/191
5,289,970 A * 3/1994 McClure ..... 229/143
5,588,585 A * 12/1996 McClure ..... 229/191
5,649,663 A * 7/1997 Pestow, Jr. ..... 229/190
5,673,848 A * 10/1997 Garza ..... 229/191
6,402,020 B1 * 6/2002 McClure ..... 229/143
6,595,411 B2 * 7/2003 McClure ..... 229/143
7,152,777 B2 * 12/2006 McClure ..... 229/143
2005/0067478 A1 3/2005 McClure

FOREIGN PATENT DOCUMENTS

GB 2236305 A * 3/1991 ..... 229/190

* cited by examiner

*Primary Examiner*—Gary E Elkins

(57) ABSTRACT

The embodiments of the present invention provide a blank foldable material that may be configured to form a container. When formed, the container is self-locking and includes top panel assemblies that form additional bearing surfaces. The blank is configured to form a container that includes corners having multiple thicknesses. However, despite the multiple thickness of the corner assemblies, the panels are only adhered in one location per corner. The single adhesion/corner arrangement provides a multi-wall corner arrangement that is strong, yet has flexible applications. The single adhesive/corner adds vertical stacking strength and lateral stability between the panels. The unique approach of only adhering at one place per corner is a space and cost saving improvement that maintains a container integrity and usefulness.

4 Claims, 6 Drawing Sheets

CONTAINER WITH REINFORCED CORNER PANELS AND THE ASSOCIATED CONTAINER BLANK

FIELD OF THE INVENTION

This invention relates generally to cellulose-based blanks and containers and more specifically, to wood cellulose-based blanks and containers used for storing and displaying goods.

BACKGROUND

Containers having multiple thickness corner assemblies are useful where increased container integrity is desired. However, a standard practice employed with using containers with multiple thickness corner assemblies is to adhere all the relative panels together with glue or other type adhesive. Conversely, the containers are often hand-set, in which case the container does not container any adhesive at all. In the former, in order to erect a container with all relative panels adhered together large box equipment is necessary, which is prohibitively costly not only in the price of the machine but in the price of the floor space required to house such a machine. In the later, the resulting hand-set box is generally not as strong.

What is needed is a method for erecting and the subsequent container that is simple to erect, cost effective and maintains desired container integrity.

BRIEF DESCRIPTION OF THE DRAWINGS

Various embodiments of the present invention are described in detail below with reference to the following drawings.

DETAILED DESCRIPTION

The present invention provides a blank and resulting container for holding any variety of goods. By way of overview and with references to FIGS. 1 through 8. An embodiment of the present invention includes a single piece blank 20 of foldable material arranged to form a container 50. Specific details of the blank 20 in container 50 are described with more particularity below.

Figure 1:
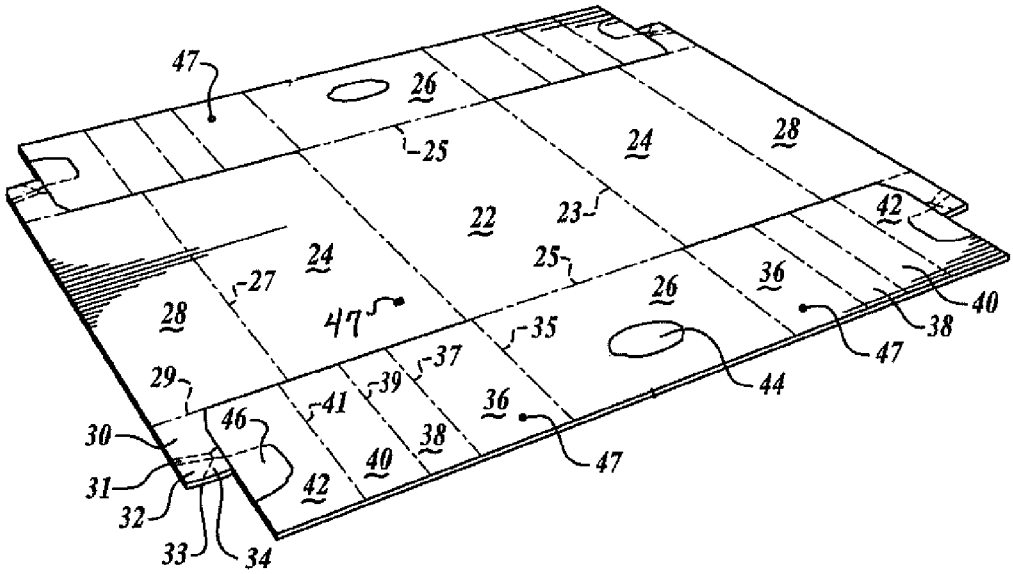
FIG. 1 is a plan view of a single piece of container plank formed in accordance with an aspect of the present invention.

FIG. 1 depicts a blank 20 used to form the container 50. The blank 20 is preferably constructed from a single piece of formable material such as, without limitation, sheets of cellulose-based materials formed from cellulose materials such as wood pulp, straw, cotton, bagasse or the like. Cellulose-based materials used in this present invention come in many forms such as fiberboard, containerboard, corrugated containerboard and paperboard. The blank 20 is cut and scored, perforated or otherwise formed to include a plurality of panels that when assembled form container 50. In all FIGURES, like numbers indicate like parts. Additionally, cut lines are shown as solid lines, score lines as dashed lines, and lines of perforation as broken lines.

With respect to FIG. 1, the blank includes a bottom panel 22, opposed side panels 24 and opposed end panels 26. The bottom panel 22 is generally rectangular in shape and is connected with the side panels along a fold line 23. The bottom panel is connected with end panels 26 along a fold line 25. As depicted in the FIGURE, fold line 23 is substantially perpendicular to fold line 25. The intersection of the respective fold lines 23 and 25 substantially define the corner of the bottom panel 22.

Side panel 24 is generally rectangular in shape. The length of the side panel 24 measured along fold line 23 is substantially equal to the length of the bottom panel 22 measured along the same fold line. Side panel 24 is connected to a top panel 28 along a fold line 27.

In an embodiment, top panel 28 is substantially rectangular in shape. The length of the top panel 28 measured along fold line 27 is substantially equal to the length of the side panel 24 measured along the same fold line. The width of the top panel 28, measure in a direction perpendicular to fold line 27, is about ½ the width of the bottom panel 22 measured along fold line 25.

Top panel 28 includes a top panel flap 30 attached to the top panel 28 along a fold line 29. The fold line 29 is substantially perpendicular to fold line 27. Attached to the top panel flap 30, opposite said top panel 28, is a locking flap 32 which is separated from top panel flap 30 via spaced apart fold lines 31. A locking tab 34 is connected with the locking flap 32 along a fold line 33. The fold line 33 and spaced apart fold lines 31 are at an acute angle relative to one another.

End panel 26 is also generally rectangular in shape. End panel 26 may include optional cut-out 44. Said cut-out 44 may be a hand-hold vent or other type structure. The length of the end panel 26 measured along fold line 25 is substantially equal to the width of the bottom panel 22 measured along the same fold line.

Attached to the end panel 26 is a first corner assembly panel 36. The first corner assembly panel 36 is connected to the end panel 26 along a fold line 35. Connected to the first corner assembly panel 36 opposite said end panel 26 is a second corner assembly panel 38. The second corner assembly panel 38 is attached with the first corner assembly panel 36 along a fold line 37. The third corner assembly panel 40 is attached to the second corner assembly panel 38 along a fold line 39. A fourth corner assembly panel 42 is connected with the third corner assembly panel along a fold line 41.

As formed the first corner assembly panel 36, second corner assembly panel 38, third corner assembly panel 40 and fourth corner assembly panel 42 lie adjacent to, but are not connected with, side panel 24 and a portion of top panel 28. The fourth corner assembly panel may include another cut-out 46 which is substantially U-shaped and formed in an edge of the fourth corner assembly panel opposite said fold line 41.

In order to further illustrate the various aspects about the embodiments, FIGS. 2 through 8, depicted the blank 20 being erected into container 50. It will be understood that mechanical box erecting equipment may be used in the erection of the container 50. However, another aspect is that this container may be hand erected at a packaging facility or the like.

Figure 2:
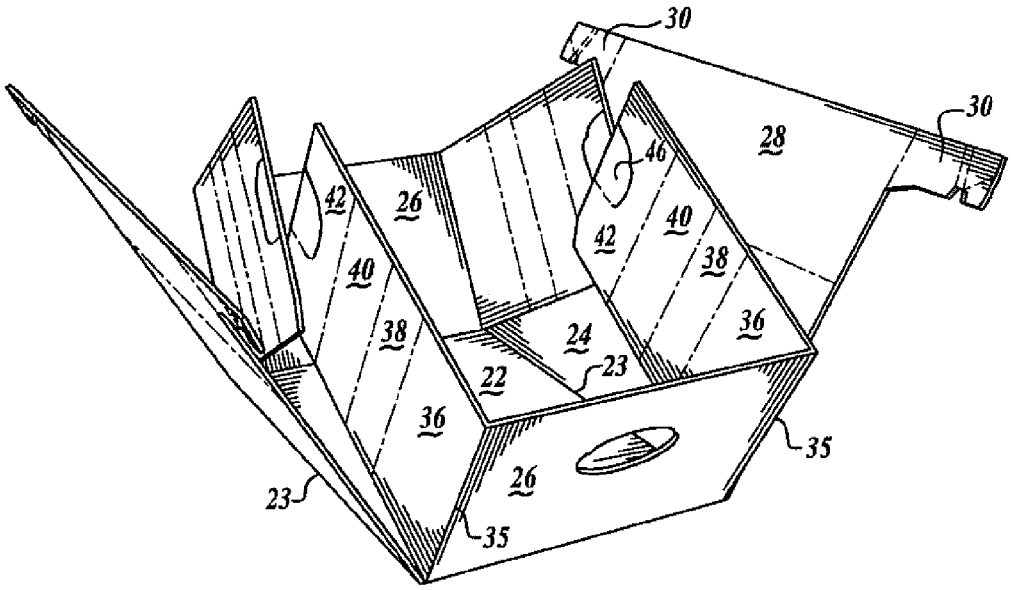
FIG. 2 is a perspective view of a partially assembled container assembly according to an aspect of the present invention.
Figure 3:
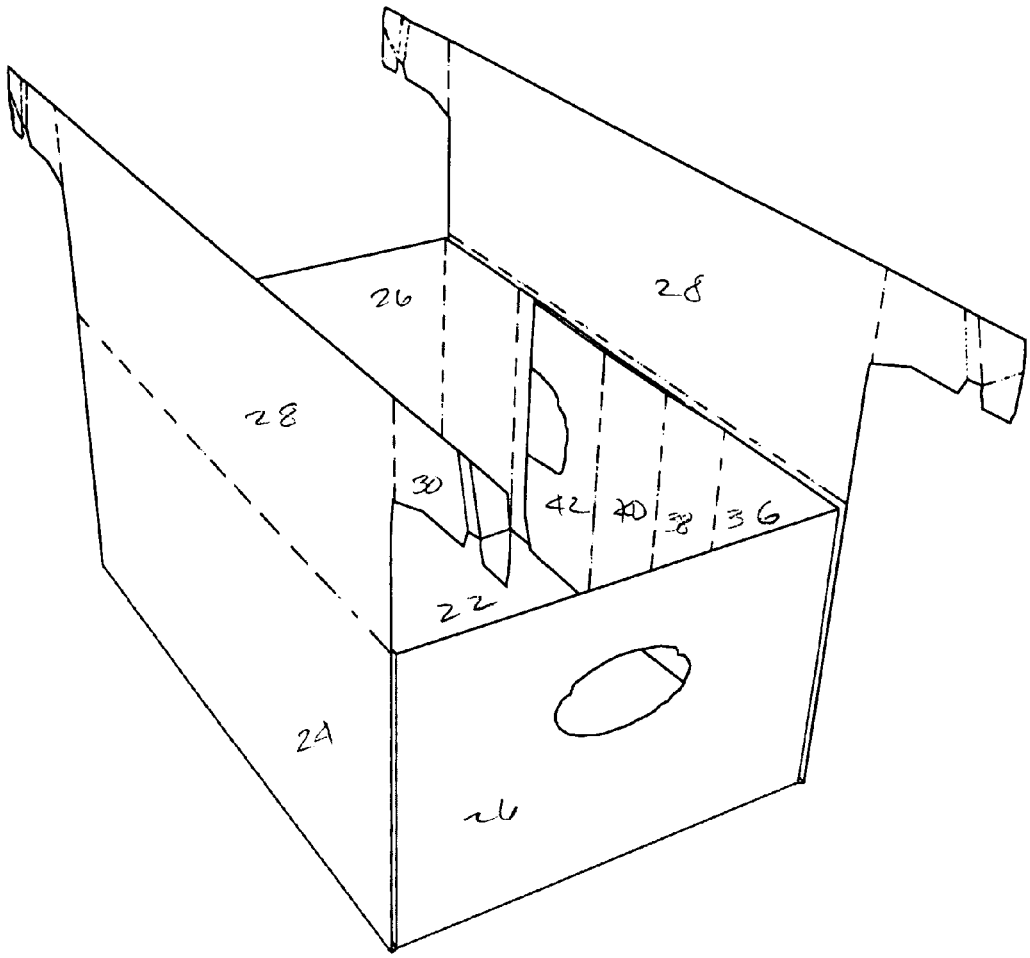
FIG. 3 is another perspective view of a partially assembled container assembly according to yet an another aspect of the present invention.

With specific reference to FIGS. 2 and 3, the first corner assembly 36, second corner assembly 38, third corner assembly 40 and fourth corner assembly 42 are folded upward approximately 90 degrees along a fold line 35. Subsequently the end panel 26 may be folded inwardly approximately 90 degrees along a fold line 25. Subsequently side panels 24 and top panels 28 are folded inwardly along a fold line 23. As best seen in FIG. 3, this relationship substantially forms the general container shape. As can be seen, one corner assembly panel associated with one end panel 26 lie adjacent to side panel 24. The opposite corner assembly panel like adjacent to first corner assembly panel, as illustrated in FIG. 3.

Figure 4:
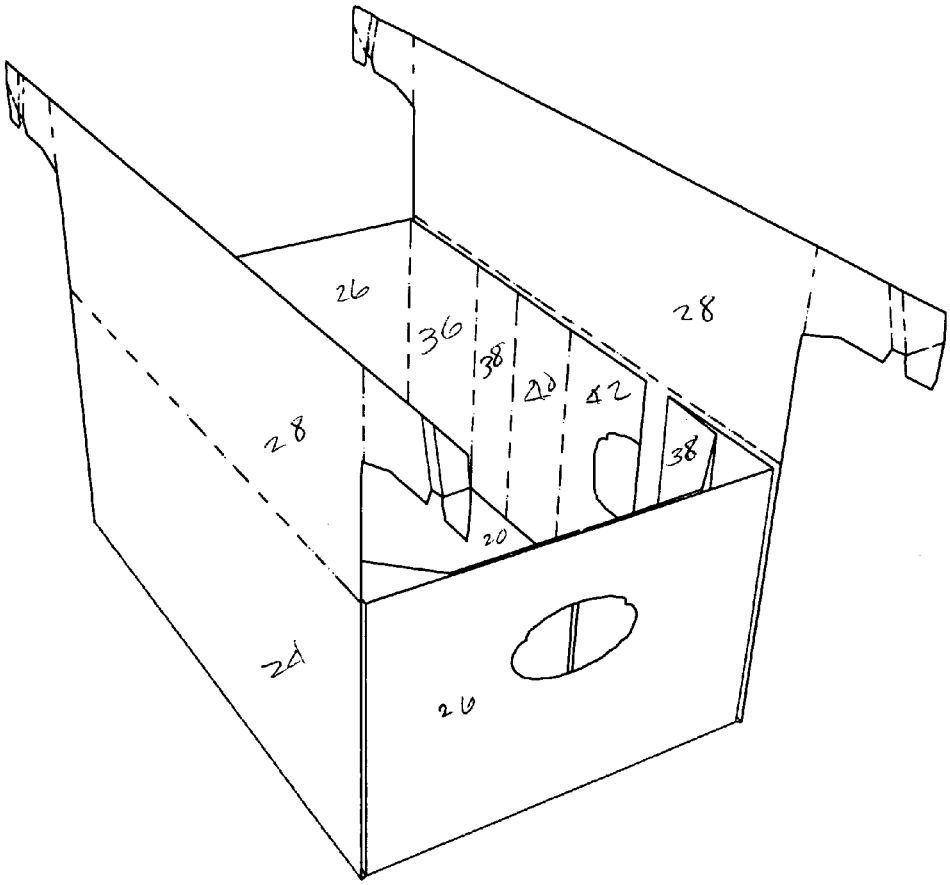
FIG. 4 is still further another perspective view of a partially assembled container assembly according to an aspect of the present invention.
Figure 5:
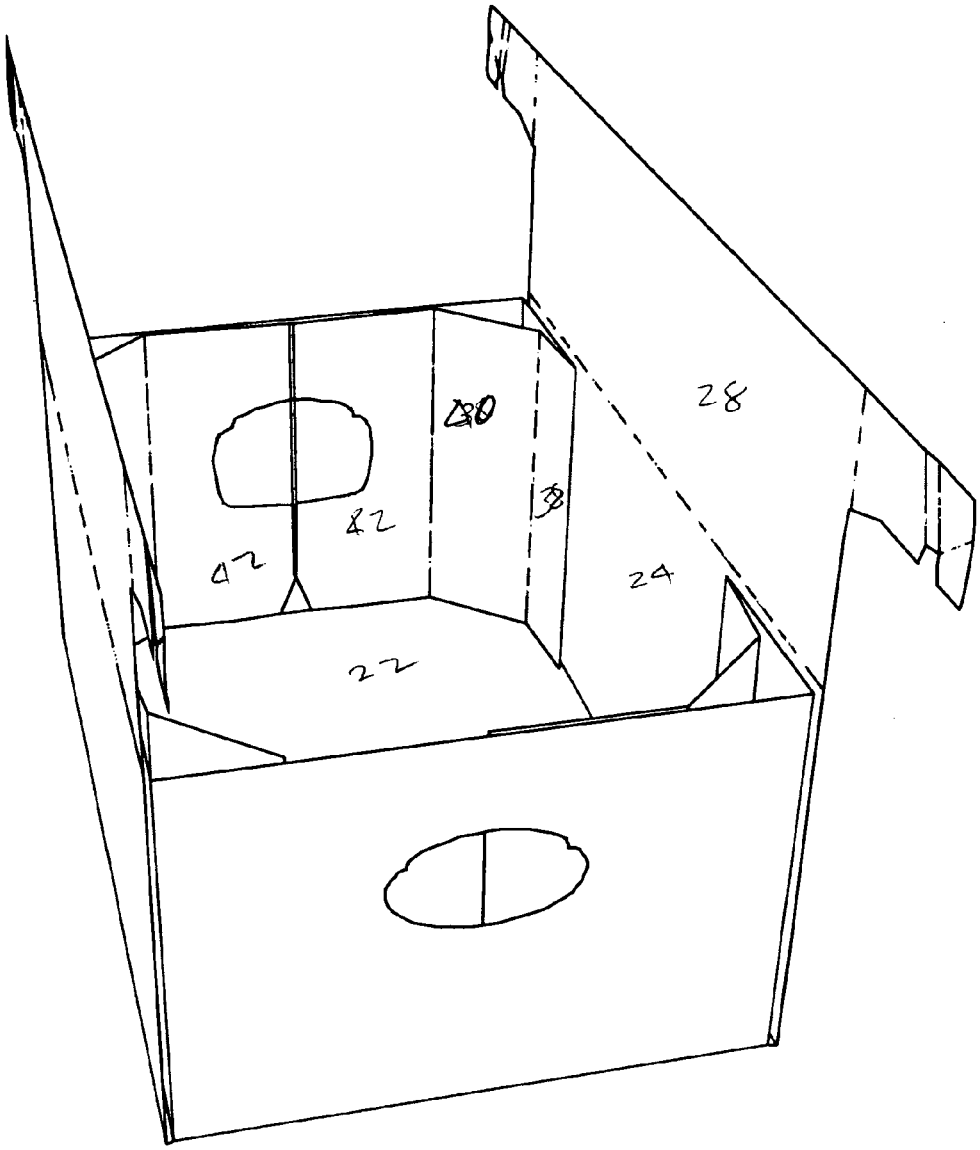
FIG. 5 is still further another perspective view of a partially assembled container assembly according to an aspect of the present invention.

With specific references now to FIGS. 4 and 5, the second corner assembly panel 38, third corner assembly panel 40, and fourth corner assembly panel 42 can be folded back along fold line 37 such that the second corner assembly panel 38 lies adjacent to the first corner assembly panel 36. The third corner assembly panel 40 extends across the corner of the container 50 and the fourth corner assembly panel 42 lies substantially adjacent to the end panel 26. As can best be seen in FIG. 5, once the various corner assembly panels are folded back into their formed position, the container 50 has all the third corner panel assemblies 40 extending across the corners forming a gusseted corner within the container 50.

Figure 6:
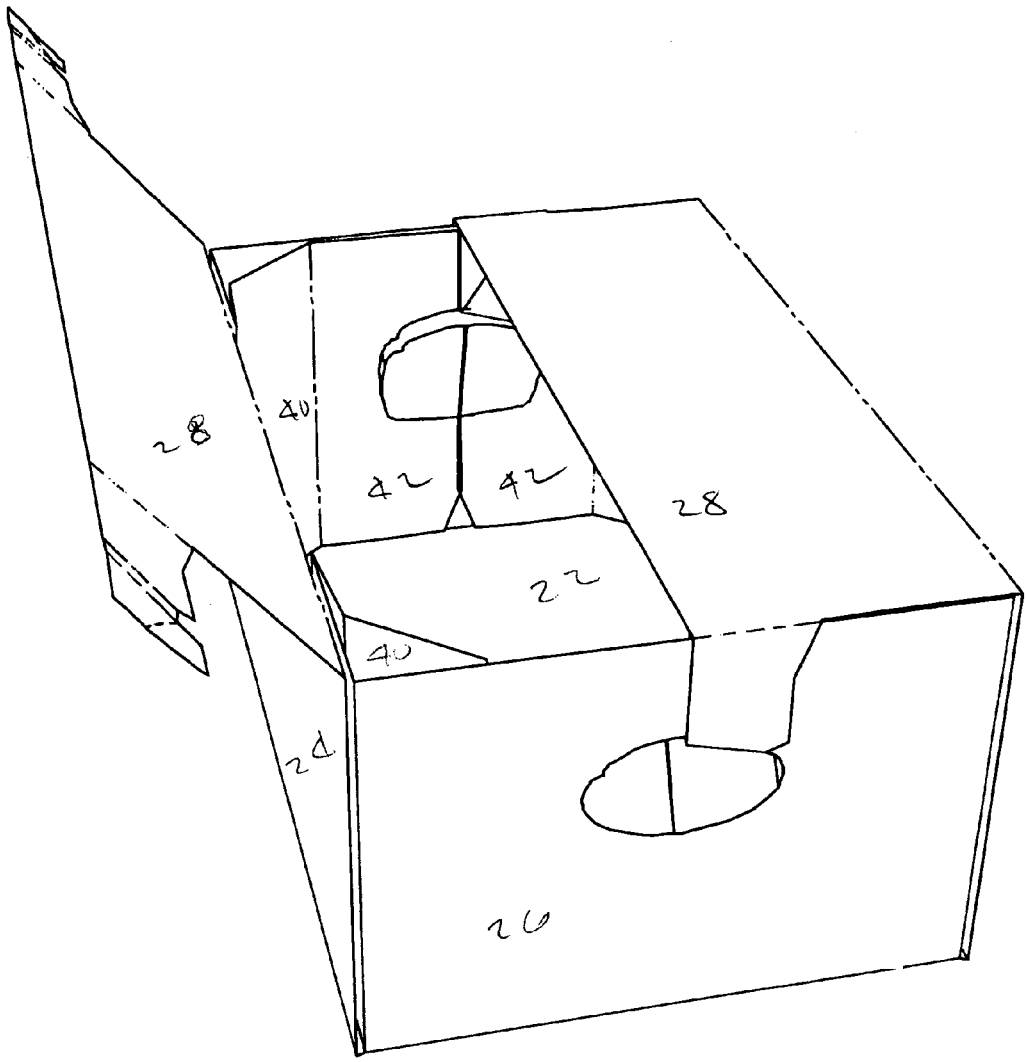
FIG. 6 is still further another perspective view of a partially assembled container assembly according to an aspect of the present invention; and, FIG. 7 is a perspective view of the assembled container according to an aspect of the present invention.
Figure 7:
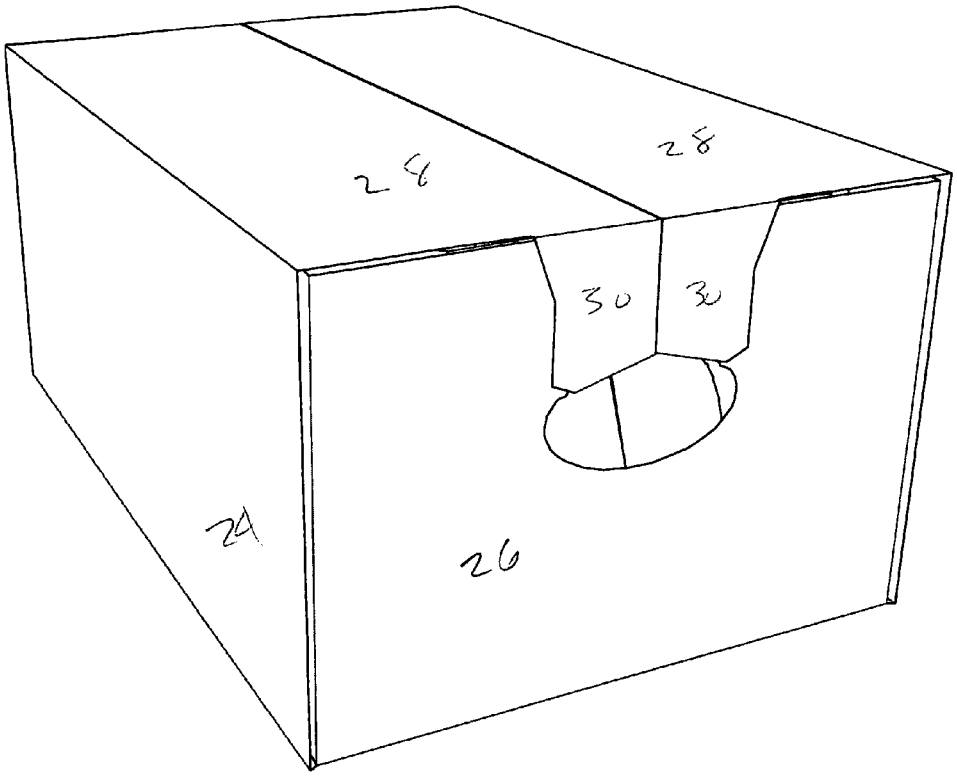

With specific reference to FIG. 7, the closing and locking of the various panels to form the container 50 is illustrated. Specifically, once the various corner assembly panels are folded to their formed position, as shown in FIGS. 6 and 7, the top panels can be folded inwardly 90 degrees along fold line 27. The top panel flap 30 can then be folded downwardly approximately 90 degrees along fold line 29 to bring the top panel flap 30, locking flap 32 and locking tab 34 into a juxtaposed position with end panel 26. The locking flap 32 and locking tab 34 can then be folded substantially through the cut-out 44 along said double spaced apart fold line 29 and fold line 31.

FIG. 8 depicts the container 50 that results from the assembly of blank 20. As can be seen in this FIGURE, the container 50 includes multi-post corner areas, where in its four corners gussets are provided via the third corner assembly panel to add to the rigidity of the container and to help control relative motion of the side panels 24 and end panels 26 and reduce telescoping of one box into the next. These assorted corner panel assemblies are configured to form multi-panel corner assemblies once the container 50 is formed. As these panels will, to an extent, fold over each, their juxtaposed positioned relative to each other combined with their association with the side panel 24 provide a container with significantly increased corner stacking strength. Further, as the various corner assembly panels are connected, and as they extend along both the side panel 24 and end panel 26, the lateral strength of the container 50 is greatly increased. Also top panel 28 provides a stacking or bearing surface for successive containers 50 to be stacked vertically on top of one another (not shown).

One of the many unique features of this embodiment is the extremely limited use of adhesive. Specifically, with reference to all FIGURES, the only adhesive used in the formation and use of container 50 is located between side panel 24 and the first corner assembly panel 36. The specific location where an adhesive 47 is placed between the respective panels will be known to those skilled in the art and it its location shown in FIG. 1 is strictly exemplary. However, it will be appreciated that the location and amount of adhesive 47 used will be sufficient to ensure container integrity. The other panels are essentially free from adhesive or the like. They may be hand set and are generally friction fit.

A unique benefit is that the forming of container 50 may be done much more efficiently than before. Specifically, if box formers are to be used in erecting the container 50, a box former having a relatively small footprint may be use. Suitable, non-limiting examples of such a box formers are the vertical box formers manufactured by either SWF, Inc. or W.E. Plemons, Inc. each of these companies manufacture relatively simple box formers having footprints around 4'×6'. This footprint is significantly smaller than box formers typically used to erect fully glued containers, which a major cost savings. Conversely, the single point of adhesive/corner provides for a container that is simple to form, yet is stronger than a basic hand-set container.

The simple adhesive arrangement of the disclosed container 50 and the minimal assembly space requirement provides a variety of efficiencies for a user. As discussed above, the actual floor space needed for either machine formation or hand formation is reduced by the unique and limited adhesive 47 application. This reduced floor space usage is a cost savings. Also, smaller entities that formerly could not justify the expense of larger box erecting equipment may now utilize less voluminous box erecting equipment and produce a container 50 having desirable structural qualities.

The container 50 as shown is simple to manufacture, easy to assemble and may be a design of considerable usage in club stores or bulk stores where products are sold in large quantities on the open floor. The container 50 may be erected by standard box erecting equipment (not shown) or else is may be hand-set and tape/glued when needed. However, this design is also useful in any variety of retail or wholesale environments.

While various embodiments of this invention have been illustrated and described, as noted above, many changes can be made without departing from the spirit and scope of this invention. Accordingly, the scope of the invention is not limited by the disclosure of the various embodiments. Instead, the invention should be determined entirely by references to the claims that follow.

What is claimed is:

1. A single sheet of foldable material cut and scored to define a container, comprising:

a bottom panel;

an end panel connected with the bottom panel;

a side panel connected with the bottom panel;

a first corner assembly panel adjacent the side panel;

a second corner assembly panel adjacent the first corner assembly panel;

a fourth corner assembly panel adjacent the end panel;

a third corner assembly panel extending between the second corner assembly panel and the fourth corner assembly panel;

a top panel hingedly attached to said side panel, opposite said bottom panel, a top panel flap hingedly attached to the top panel;

a locking flap hingedly attached to the top panel flap opposite the top panel; and a locking tab hingedly attached to the locking flap, wherein the only place adhesive is placed is between the first corner assembly panel and the side panel.

2. The container of claim 1, wherein the single sheet of foldable material is formed from a cellulose-based material.

3. The container of claim 2, wherein the cellulose based material is formed from at least one of a wood pulp, straw, cotton, and bagasse.

4. The container of claim 2, wherein the cellulose based material is in the form of at least one of a fiberboard, containerboard, corrugated containerboard and paperboard.

* * * * *